US006456803B2

(12) United States Patent
Suzuki et al.

(10) Patent No.: US 6,456,803 B2
(45) Date of Patent: Sep. 24, 2002

(54) IMAGE FORMING APPARATUS CAPABLE OF DETECTING BOTH OF REGULARLY REFLECTED LIGHT AND IRREGULARLY REFLECTED LIGHT

(75) Inventors: Kazuo Suzuki, Yokohama; Takao Ogata; Nobuhiko Zaima, both of Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/774,109

(22) Filed: Jan. 31, 2001

(30) Foreign Application Priority Data

Feb. 4, 2000 (JP) ..... 2000-032826
Jun. 27, 2000 (JP) ..... 2000-193164

(51) Int. Cl.[7] ..... G03G 15/00; G03G 15/08
(52) U.S. Cl. ..... 399/49; 358/298
(58) Field of Search ..... 399/49, 53, 74; 347/131; 250/338.1, 339.11, 341.8; 356/445, 446, 448; 358/406, 504, 296, 298

(56) References Cited

U.S. PATENT DOCUMENTS 5,697,012 A 12/1997 Sasanuma et al. ..... 399/49
5,991,558 A * 11/1999 Emi et al. ..... 399/49
6,215,968 B1 * 4/2001 Uehara et al. ..... 399/49
6,223,007 B1 * 4/2001 Kitagawa et al. ..... 399/49

FOREIGN PATENT DOCUMENTS

JP 10-031333 * 2/1998
JP 2000-39746 * 2/2000

* cited by examiner

*Primary Examiner*—Sophia S Chen
(74) *Attorney, Agent, or Firm*—Fitzpatrick, Cella, Harper & Scinto

(57) ABSTRACT

The present invention provides an image forming apparatus that has image forming device for forming a toner image, first detecting device for detecting the quantity of regularly reflected light from the toner image, and second detecting device for detecting the quantity of irregularly reflected light from the toner image.

6 Claims, 9 Drawing Sheets

IMAGE FORMING APPARATUS CAPABLE OF DETECTING BOTH OF REGULARLY REFLECTED LIGHT AND IRREGULARLY REFLECTED LIGHT

BACKGROUND OF THE INVENTION

1. Field of the Invention

This invention relates to an image forming apparatus such as a copier or a printer using the electrophotographic process or the electrostatic recording process.

2. Related Background Art

FIG. 9 of the accompanying drawings schematically shows the construction of a color image forming apparatus. This color image forming apparatus has a digital color image reader portion in the upper portion thereof, and a digital color image printer portion in the lower portion thereof.

In the digital color image reader portion, and original 30 is placed on an original supporting glass table 31, and a reflected optical image from the original 30 exposed and scanned by an exposure lamp 32 is condensed on a full color sensor 34 by a lens 33 to thereby obtain a color resolved image signal.

The color resolved image signal is processed by a video processing unit, not shown, via an amplifying circuit, not shown, and is delivered to the digital color image printer portion.

In the digital color image printer portion, a photosensitive drum 1 which is an image hearing member is supported for rotation in the direction of arrow R1. Around this photosensitive drum 1, there are disposed a pre-exposure lamp 11, a corona charger 2, a laser beam exposing optical system 3, a potential sensor 12, four developing devices 4*y*, 4*c*, 4*m*, 4*bk*, a density detecting sensor 13 as density detecting means, a transferring apparatus 5 and a cleaning device 6.

The color resolved image signal from the digital color image reader portion is inputted to the laser beam exposing optical system 3, and the color resolved image signal is converted into an optical signal by a laser output portion, not shown, whereafter a laser beam is reflected by a polygon mirror 3*a*, and is converted into an optical image E passing through a lens 3*b* and a mirror 3*c* and linearly scanning (raster scanning) the surface of the photosensitive drum 1.

During the image formation in the digital color image printer portion, the photosensitive drum 1 is first rotated in the direction of arrow R1, and the surface thereof is deelectrified by the pre-exposure lamp 11, where after it is uniformly charged by the corona charger 2, and the optical image E is applied to this charged surface for each resolved color to thereby form an electrostatic latent image.

Next, a predetermined developing device is operated for each resolved color to thereby develop and visualize the electrostatic latent image on the photosensitive drum 1, and an image by a toner as a developer having resin as a base substance is formed on the photosensitive drum 1.

Here, the developing devices 4*y*, 4*c*, 4*m* and 4*bk* are adapted to be selectively moved toward the photosensitive drum 1 in conformity with respective resolved colors by the operation of eccentric cams 24*y*, 24*c*, 24*m* and 24*bk*.

Further, the toner image as developer image on the photosensitive drum 1 are transferred to a recording material as a sheet supplied from a recording material cassette 7 to a position opposed to the photosensitive drum 1 through a conveying system and the transferring apparatus.

The transferring apparatus 5 has, in the present example, a transferring drum 5*a*, a transferring charger 5*b*, an adsorbing charger 5*c* for electrostatically adsorbing the recording material, an adsorbing roller 5*g* opposed to the adsorbing charger 5*c*, an inner side charger 5*d* and an outer side charger 5*e*, and a recording material carrying sheet 5*f* formed of a dielectric material is cylindrically integrally extended in the opening area of the peripheral surface of the transferring drum 5*a* journalled so as to be rotatively driven.

As the recording material carrying sheet 5*f*, use is made of a dielectric material sheet such as polycarbonate film.

As the transferring drum 5*a* is rotated, the toner image on the photosensitive drum 1 are transferred onto the recording material carried on the recording material carrying sheet 5*f*, by the transferring charger 5*b*.

As described above, a desired number of color images are transferred to the recording material adsorbed and conveyed by the recording material carrying sheet 5*f*, and finally a full color image is formed on the recording material.

In the case of a four-color mode, when the transfer of the toner images of four colors to the recording material is completed in this manner, the recording material is separated from the recording material carrying sheet 5*f* by the action of a separating pawl 8*a*, a separating push-up roller 8*b* and a separating charger 5*h*, and the toner images and fixed on the recording material through a heat roller fixing device 9 and the recording material is discharged onto a tray 10.

Also, after the transfer, the photo-sensitive drum 1 has the residual toners on its surface removed by the cleaning device 6, and thereafter is again used for the image forming process.

When images are to be formed on both surfaces of the recording material, immediately after the recording material has been discharged from the fixing device 9, a conveying path changeover guide 19 is driven, and the recording material is guided to a reversal path 21*a* via a sheet discharge vertical path 20, whereafter the recording material is once stopped, and is caused to leave in a direction opposite to the direction in which it has been fed in with the trailing end thereof when fed in as the leading end by the reverse rotation of reversing rollers 21*b*, and the recording material is reversed and stocked in an intermediate tray 22. Thereafter an image is again formed on the other surface of the recording material by the image forming process.

Also, the recording material carrying sheet 5*f* on the transferring drum 5*a* is contaminated by the scattering and adherence of powder from the photosensitive drum 1, the developing devices 4, the cleaning device 6, etc., the adherence of the toners during the jam of the recording material, and sometimes the adherence of oil on the recording material during the image formation on the both surfaces of the recording material, but is cleaned by the action of a fur brush 14 and a backup brush 15 opposed to the fur brush 14 with the recording material carrying sheet 5*f* interposed therebetween, and an oil removing roller 16 and a backup brush 17 opposed to the oil removing roller 16 with the recording material carrying sheet 5*f* interposed therebetween, and thereafter is used again for the image forming process. Such cleaning is effected during pre-rotation and during post-rotation, and is effected whenever jam occurs.

In the present example, design is made such that the eccentric cam 25 of the transferring drum is operated and a cam follower 5*i* made integral with the transferring drum 5*a* is operated, whereby the gap between the recording material carrying sheet 5*f* and the photosensitive drum 1 can be set to a predetermined spacing at predetermined timing. For example, it is a construction in which during standby or during the OFF of power source, the spacing between the transferring drum 5*a* and the photosensitive drum 1 is made great and the rotation of the transferring drum 5*a* can be made independent of the rotative driving of the photosensitive drum 1.

Also, each developing device is provided with first and second agitating and carrying means designed to carry the toner in opposite directions. Also, a developing sleeve is disposed above the first agitating and carrying means.

In the above-described series of image forming operations, the developing device operates as follows. When the photosensitive drum 1 is rotated and the electrostatic latent image thereon arrives at a developing position, a developing bias comprising AC and DC superimposed one upon the other is applied from a developing bias voltage source to the developing sleeve, and the developing sleeve is rotated by a developing sleeve driving device, not shown, and the developing device is pressed toward the photosensitive drum 1 by a developing pressing cam to thereby visualize the electrostatic latent image by the toner.

Also, the density detecting sensor 13, as shown in FIG. 2A of the accompanying drawings, is a regularly reflected light sensor 13*a* as regularly reflected light detecting means using a near infrared light LED 13*c* as a light emitting element and a photodiode 13*d* as a light receiving element to detect the quantity of regularly reflected light to the light applied to the visualized toner image on the photosensitive drum 1. It controls the toner/carrier density when a two-component developer is used as the developer, from the toner density of the toner image converted from the detected quantity of regularly reflected light, or controls the charging bias by the corona charger 2.

However, in the density detecting sensor 13 which is the regularly reflected light sensor 13*a* according to the prior art for detecting the quantity of regularly reflected light as described above, the detection output is saturated during a density change in the high density area of the toner density, as shown in FIG. 2B of the accompanying drawings, and it has been difficult to detect the density. Therefore, the density detection control of a low density area to a medium density area has been possible, but the density detection control in a high density area near the maximum density could not be effected.

SUMMARY OF THE INVENTION

It is an object of the present invention to provide an image forming apparatus in which the detection of density from low density to high density can be effected.

It is another object of the present invention to provide an image forming apparatus comprising:

image forming means for forming a toner image;

first detecting means for detecting a quantity of regularly reflected light from the toner image; and second detecting means for detecting a quantity of irregularly reflected light from the toner image.

Further objects of the present invention will become apparent from the following description.

DESCRIPTION OF THE PREFERRED EMBODIMENTS

Some embodiments of the present invention will hereinafter be described with reference to the drawings.

Figure 9:
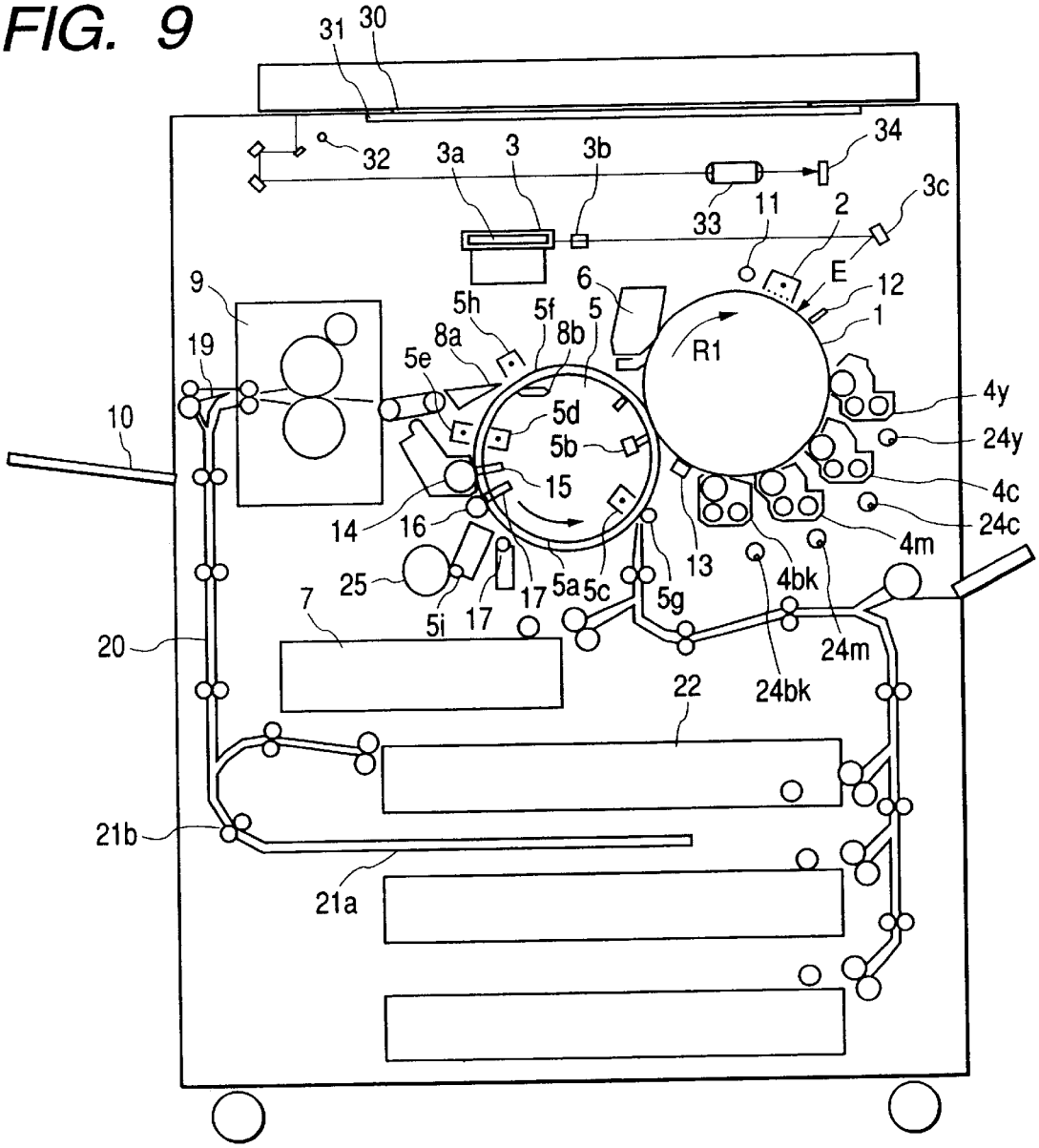
FIG. 9 schematically shows the construction of an image forming apparatus.

The description of the constructions and functions of portions common to the example shown in FIG. 9 will be omitted.

(First Embodiment)

Figure 1A:
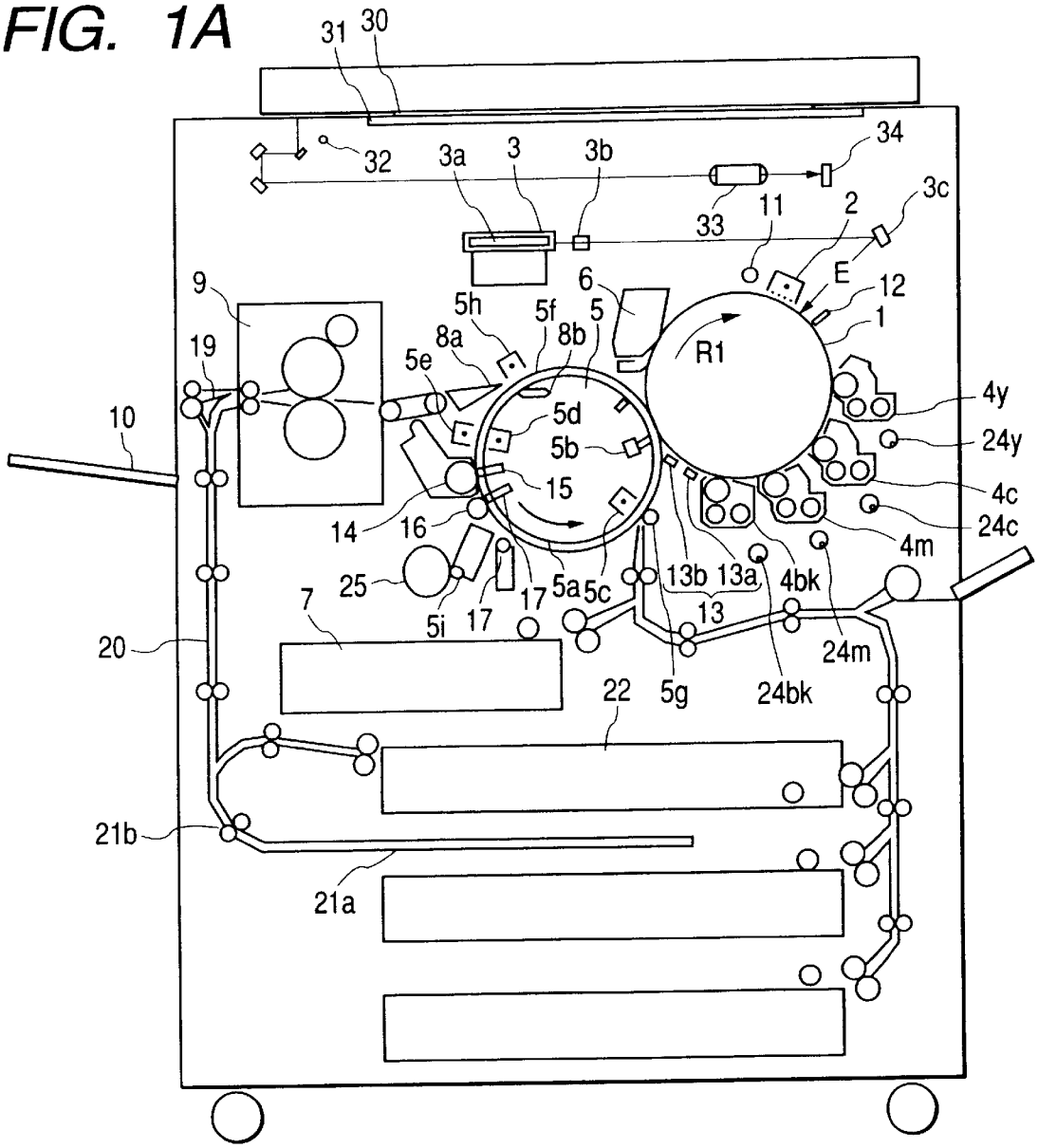
FIG. 1A schematically shows the construction of an image forming apparatus according to a first embodiment of the present invention.
Figure 1B:
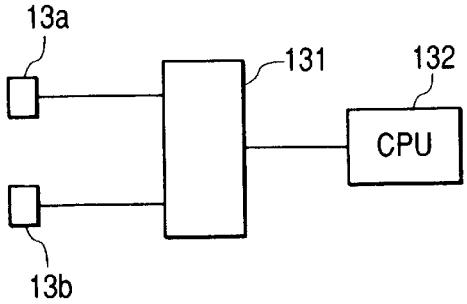
FIG. 1B is a block diagram in which sensor outputs are converted.

A first embodiment will hereinafter be described with reference to FIGS. 1A, 1B, 2 and 3. As shown in FIGS. 1A and 1B, in the present embodiment, a density detecting sensor 13 as density detecting means for detecting a toner image as a developer image on a photosensitive drum 1 is comprised of a regularly reflected light sensor 13*a* and an irregularly (diffusely) reflected light sensor 13*b* as two regularly reflected light density means and irregularly reflected light detecting means disposed in opposed relationship with the photosensitive drum 1.

Figure 2A:
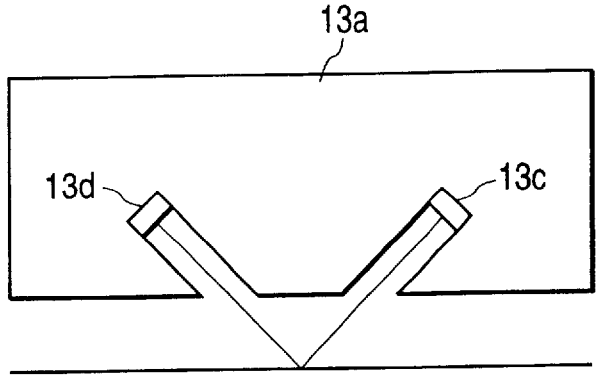
FIGS. 2A and 2B are a schematic view and a graph, respectively, showing the construction and characteristic of a regularly reflected light sensor.

The regularly reflected light sensor 13*a,* as shown in FIG. 2A, irradiating the toner image with an irradiating light from an reflected light thereof by a photodiode 13*d.*

Figure 3A:
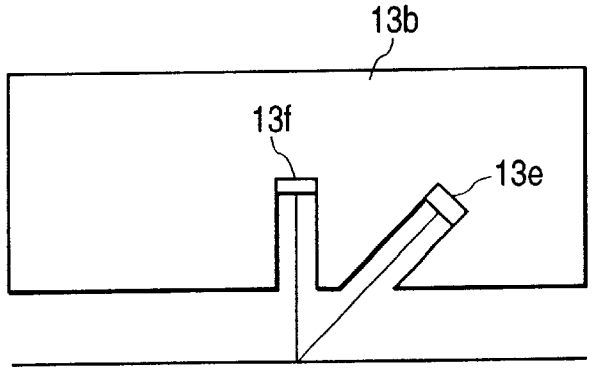
FIGS. 3A and 3B are a schematic view and a graph, respectively, showing the construction and characteristic of an irregularly reflected light sensor.

The irregularly reflected light sensor 13*b,* as shown in FIG. 3A, irradiates the toner image with an irradiating light from an LED 13*e,* and receives the irregularly reflected light thereof by a photodiode 13*f.* As shown in FIG. 1B, the outputs of the sensors 13*a* and 13*b* are selected by a selector 131 and subjected to predetermined conversion, and thereafter are sent to a CPU 132.

Figure 2B:
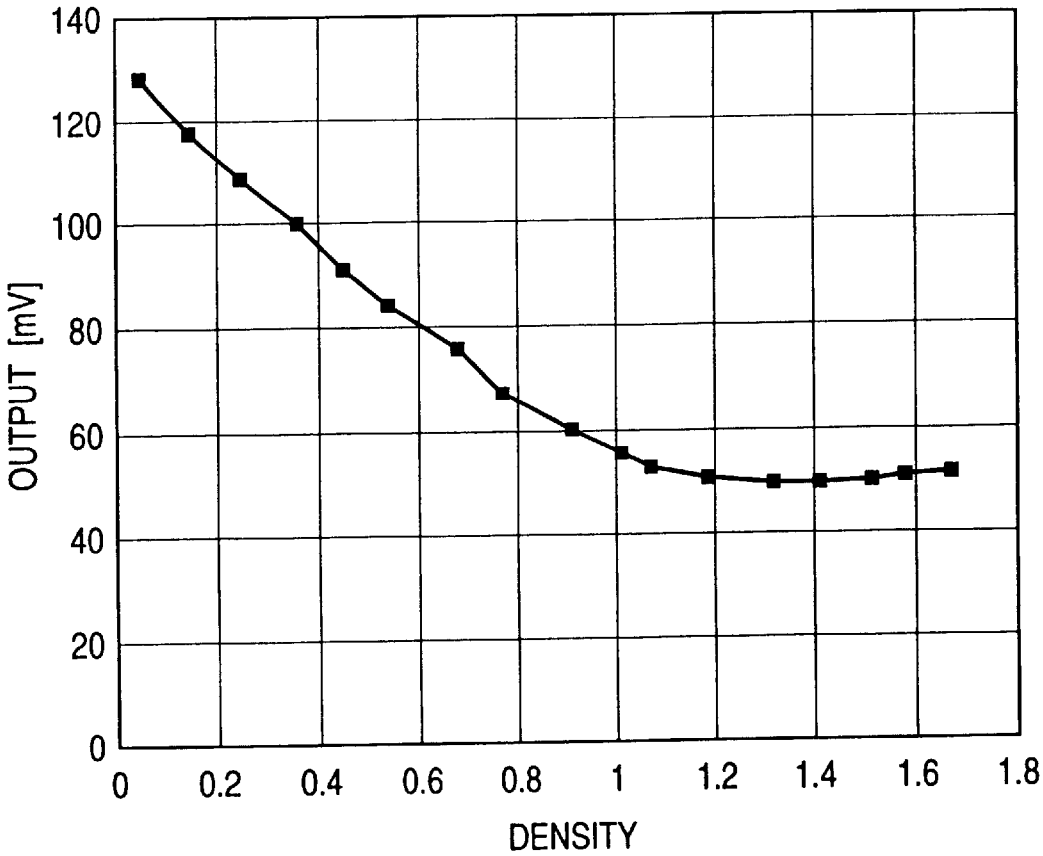
Figure 3B:
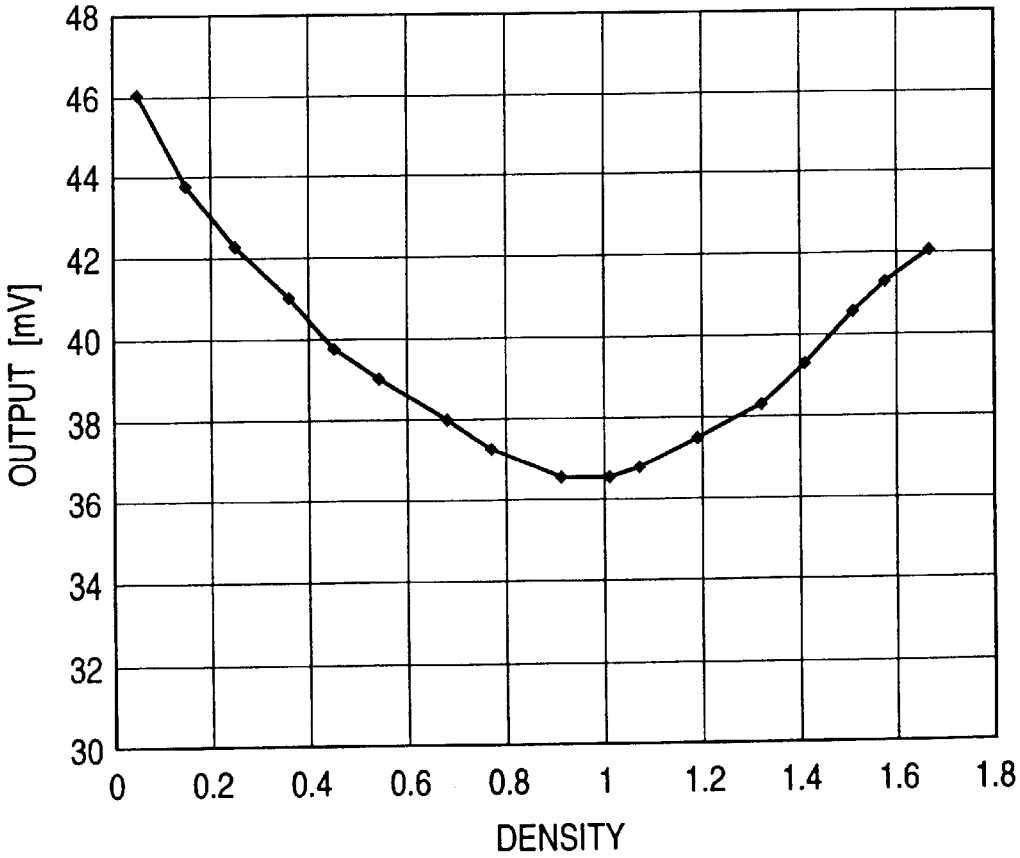

Graphs showing the relation between the characteristics of the detection outputs of the sensors 13*a* and 13*b* for the density of the toner image are shown in FIGS. 2B and 3B.

As shown in FIG. 2B, the detection output of the regularly reflected light sensor 13*a* has a characteristic of becoming saturated in a high density are a of density 1.0 or greater, and sufficient sensor sensitivity is not obtained in the high density area, and the detection of the density of the high density area is difficult.

On the other hand, as shown in FIG. 3B, the detection output of the irregularly reflected light sensor 13*b* has a U-shaped characteristic in which a medium density area in the vicinity of density 1.0 is the bottom and the detection output rises toward a low density area and a high density area, a density cannot be uniquely determined from the detection output.

So, in the present embodiment, the following construction is used as a method of combining the regularly reflected light sensor 13*a* and the irregularly reflected light sensor 13*b* together to thereby uniquely detect the density of the whole area from the low density area to the light density area.

In the present embodiment, batches of image ratios 20%, 40%, 60%, 80% and 100% which are the densities of the toner image are formed on the photosensitive drums 1, and the batches of image ratios 20%, 40% and 60% for which the density becomes 1.0 or less without fail even if the endurance of the main body of the apparatus, the fluctuations of the environment, etc. are taken into account are density-detected by the regularly reflected light sensor 13*a,* and the batches of image ratios 80% and 100% for which the density becomes greater than 1.0 without fail even if the endurance of the main body, the fluctuation of the environment, etc. are taken into account are density-detected by the irregularly reflected light sensor 13*b*.

The regularly reflected light sensor 13*a* and the irregularly reflected light sensor 13*b,* as shown in FIGS. 2B and 3B, can effect density detection in areas wherein the linearity of the sensor sensitivity thereof is good, and therefore can accurately detect the density of the toner image in the whole area.

That is, the batches of image ratios 20%, 40% and 60% for which the density becomes 1.0 or less is the low density area to the medium density area, and the regularly reflected light sensor 13*a* having the characteristic of FIG. 2B can well detect the density because the detection output thereof is not saturated in these density areas.

On the other hand, the batches of image ratios 80% and 100% for which the density becomes greater than 1.0 are the high density area, and the irregularly reflected light sensor 13*b* having the characteristic of FIG. 3B can well detect the density because when only this density area is to be density-detected, the density of the toner image can be uniquely determined from the detection output.

As described above, in the present embodiment, the regularly reflected light sensor 13*a* for detecting the density of the visualized toner image by the quantity of regularly reflected light and the irregularly reflected light sensor 13*b* for detecting the density of the visualized toner image by the quantity of irregularly reflected light are provided as density detecting sensors, and when the density of the toner image is to be detected, density detection is effected in the high density area by the irregularly reflected light sensor 13*b* and in the low and medium density areas by the regularly reflected light sensor 13*a,* whereby the density of the toner image can be accurately detected in the whole area from the low density area to the high density area.

(Second Embodiment)

This embodiment is an example of the application of the first embodiment. The portions of this embodiment which are similar to those of the first embodiment need not be described, and the characteristic portion thereof will be described in detail.

In the first embodiment, setting has been made so that the batches of image ratios 20%, 40% and 60% are density-detected by the regularly reflected light sensor 13*a* and the batches of image ratios 80% and 100% are density-detected by the irregularly reflected light sensor 13*b*. However, when the construction of the first embodiment is applied to an apparatus in which the density fluctuation by changes in the environment, endurance deterioration or the like is great, it has sometimes been the case that for example, at a certain time, the batch of image ratio 60% is an area for which the linearity of the sensitivity of the regularly reflected light sensor 13*a* is good and density detection is possible, whereas at other time, the batch of image ratio 60% becomes an area for which the linearity of the sensitivity of the regularly reflected light sensor 13*a* is bad.

So, in the present embodiment, the detection of the batches is effected as follows. The batches are formed in the order from the batch of 20% which is small in image percentage, and the density is detected by the regularly reflected light sensor 13*a*. Regarding a batch for which the detection output of the regularly reflected light sensor 13*a* becomes less than 55 mV and a predetermined quantity of light has become undetectable, density detection is effected by the irregularly reflected light sensor 13*b,* and the subsequent batches in the high density area which are greater in image ratio are also density-detected by the irregularly reflected light sensor 13*b*.

When such a density detecting method is used, the above-noted problem arising in the boundary between the area for which the linearity of the sensitivity of the regularly reflected light sensor 13*a* is good and the area for which the aforementioned linearity becomes bad can be solved, and even when the density fluctuation by changes in the environment, endurance deterioration or the like is great, the density of the toner image in the-whole area from the low density area to the high density area can be detected accurately.

(Third Embodiment)

This embodiment is an example of the application of the first embodiment to maximum density control and gradation control. The portions of this embodiment which are similar to those of the first embodiment need not be described and the characteristic portion thereof will be described in detail.

The density control of the present embodiment is divided broadly into two kinds, i.e., maximum density control and gradation control.

More particularly, they are Dmax control as maximum density control for controlling charging potential and a developing bias valve to detect maximum density and control the maximum density, and Dhalf control as gradation control for controlling γ-LUT to detect highlight density and control the highlight density.

Figure 4:
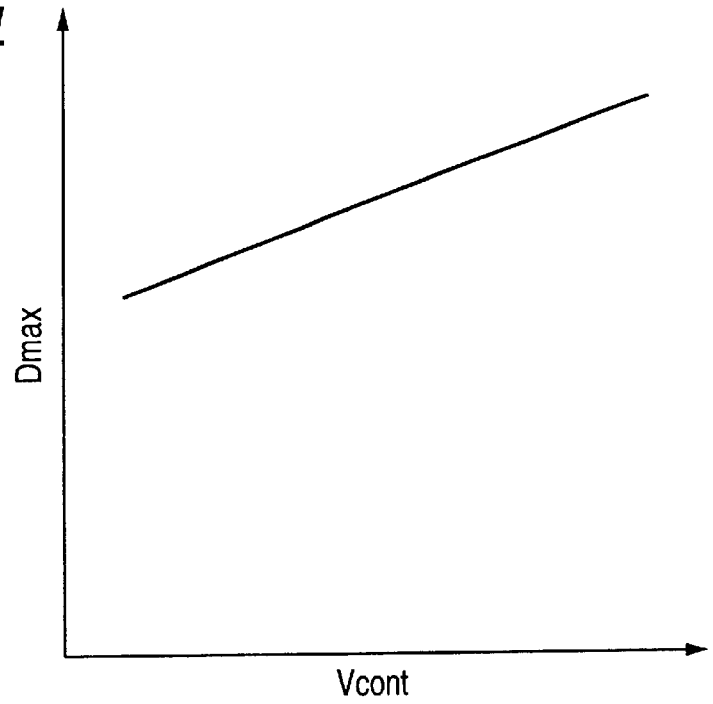
FIG. 4 is a graph showing the relation between maximum density Dmax and contrast potential (Vcont).
Figure 5:
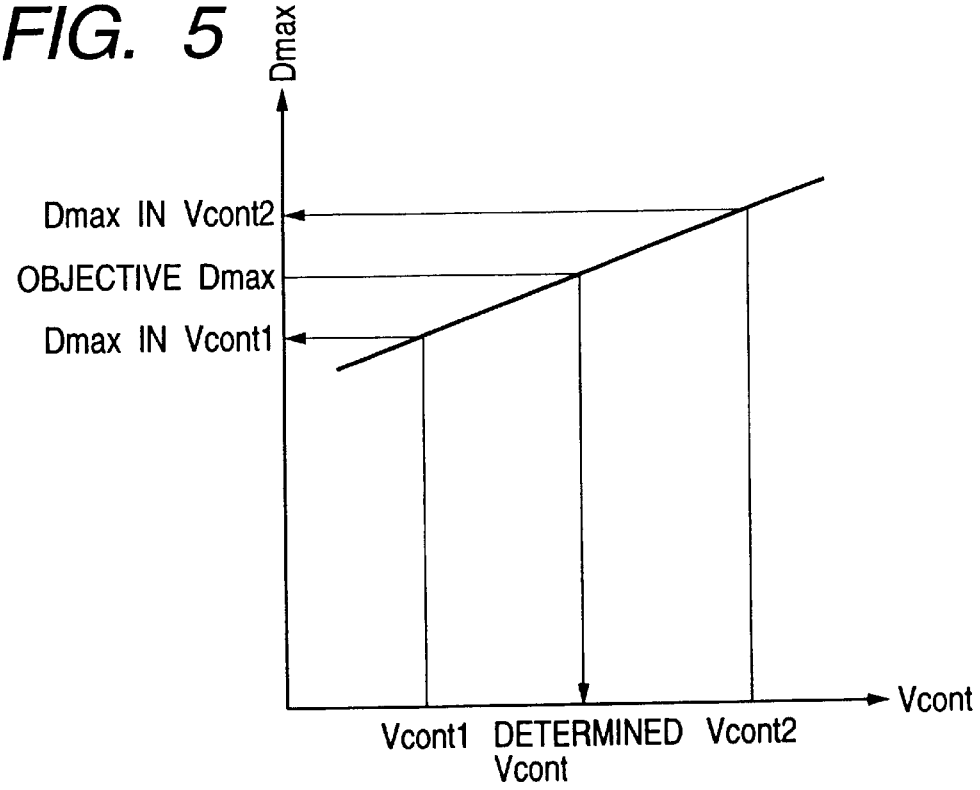
FIG. 5 is a graph showing maximum density control for determining desired contrast potential for obtaining objective maximum density Dmax.

Dmax control will first be described. In the present embodiment, Dmax control controls the maximum density so as to keep it constant even if the environment and endurance change. As shown in FIG. 4, the maximum density Dmax can be controlled by changing contrast potential (Vcont). So, a plurality of batches of image ratio 100% are formed while the contrast potential is changing as shown in FIG. 5, for example from Vcont1 to Vcont2, and desired contrast potential which is the objective maximum density Dmax is determined.

Figure 6:
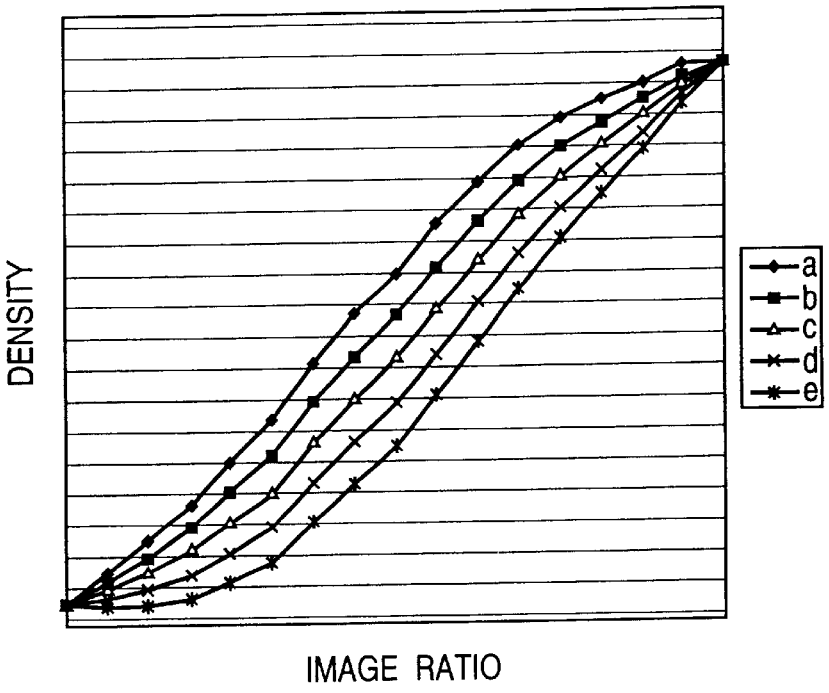
FIG. 6 is a graph showing changes in gradation property.
Figure 7:
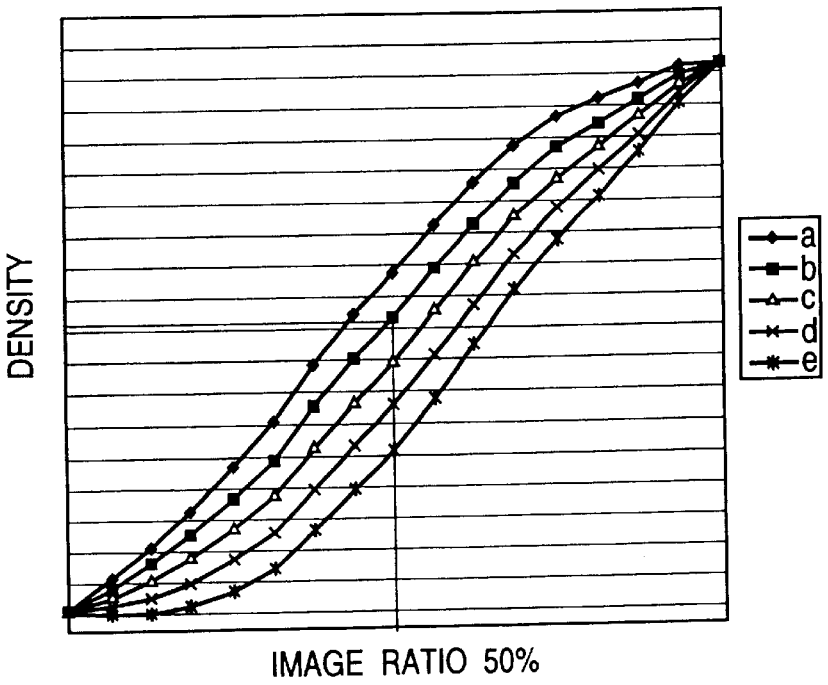
FIG. 7 is a graph showing gradation control for obtaining predetermined gradation property.

Dhalf control will now be described. In the present embodiment, Dhalf control selects and controls γ-LUT to optimum one so as to keep the gradation property constant even if the environment and endurance change. The gradation property changes as shown in FIG. 6 and therefore, as shown in FIG. 7, a batch of image ratio 50% is formed, and is density-detected by the regularly reflected light sensor 13*a* and γ-LUT is selected from among five kinds a to e.

Here, as described above, in the present embodiment, the batch of image ratio 100% is used for maximum density control and therefore, density detection is effected by the irregularly reflected light sensor 13*b* which is good in the linearity of sensitivity in the light density area thereof, and the batch of image ratio 50% is used for the control of the gradation property and therefore, density detection is effected by the regularly reflected light sensor 13*a* which is good in the linearity of sensitivity in that density area.

Again in the present embodiment, the regularly reflected light sensor 13*a* and the irregularly reflected light sensor 13*b* are used properly in conformity with the image ratios of the batches used for the maximum density control and the gradation property control, respectively, whereby the accuracy of density control can be improved.

(Fourth Embodiment)

This embodiment is one in which an integral type sensor comprising the two sensors used in the first embodiment, i.e., the regularly reflected light sensor 13*a* and the irregularly reflected light sensor 13*b,* made integral with each other is used as the density detecting sensor 13. The same portions of this embodiment as those of the first embodiment need not be described, and the characteristic portion thereof will be described in detail.

Figure 8:
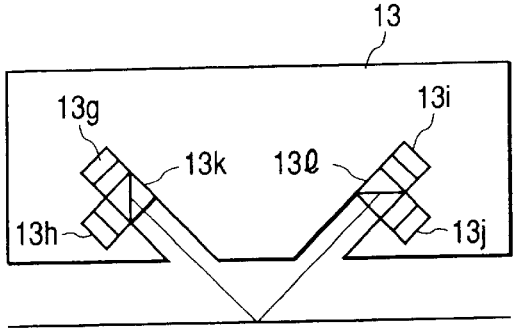
FIG. 8 schematically shows the construction of a density detecting sensor according to a fourth embodiment of the present invention.

In the present embodiment, use is made of a sensor as shown in FIG. 8 which can detect the quantity of regularly reflected light and the quantity of irregularly reflected light at a time.

The reference character 13*g* designates an LED, the reference characters 13*h,* 13*i* and 13*j* denote photodiodes, and the reference characters 13*k* and 13*l* designate prisms.

The irradiating light by the LED 13*g* is separated by the prism 13*k* into a component vibrating in a direction perpendicular to the incidence surface (which light is hereinafter sometimes termed "S1 wave light" for convenience) and a component vibrating in a direction parallel to the incidence surface (which light is hereinafter sometimes termed "P1 wave light" for convenience). The S1 wave light is applied to the photodiode 13*h,* and the P1 wave light is applied to a toner surface on which the toner image is formed. The P1 wave light applied to the toner surface is reflected, passes through the prism 13*l* and is separated into S2 wave light and P2 wave light, and the P2 wave light is received by the photodiode 13*i* and the quantity of regularly reflected light thereof is detected, and the S2 wave light is received by the photodiode 13J and the irregularly reflected light thereof is detected.

In such an integral type sensor which can detect the quantity of regularly reflected light and the quantity of irregularly reflected light at a time, the detection outputs of the quantity of regularly reflected light and the quantity of irregularly reflected light for the density of the toner image have become similar to the characteristics shown in FIGS. 2B and 3B.

Accordingly, as in the first embodiment, the batches of image ratios 20%, 40% and 60% detect the quantity of regularly reflected light and the batches of image ratios 80% and 100% detect the quantity of irregularly reflected light, whereby the whole area from the low density area to the high density area can be density-detected accurately and further, the density detecting sensor may be an integral type sensor and therefore, the space for installation may be small, and only the density detecting sensor 13 can be interchanged in the apparatus construction according to the prior art, and there has been no necessity of changing the design and this has been effective in respect of cost.

A similar effect can be obtained even if a correcting method not shown in the above-described embodiments is used or the density of the toner image is detected not on the photosensitive drum 1 but on a transferring member, an intermediate transferring member or the like.

(Fifth Embodiment)

In this embodiment, a method of uniquely detecting the density from the low density portion to the high density portion by combining the regularly reflected light and the irregularly reflected light together is used as follows.

For a regularly reflected light output of 55 mV or greater corresponding to density 1.0, only the regularly reflected light is corrected, and for a regularly reflected light output of less than 55 mV, the regularly reflected light and in addition, an irregularly reflected light (the difference between the detected value of the quantity of irregularly reflected light and the lowest value of the detected value of the quantity of irregularly reflected light) multiplied by a predetermined coefficient (magnification) are corrected.

Figure 10:
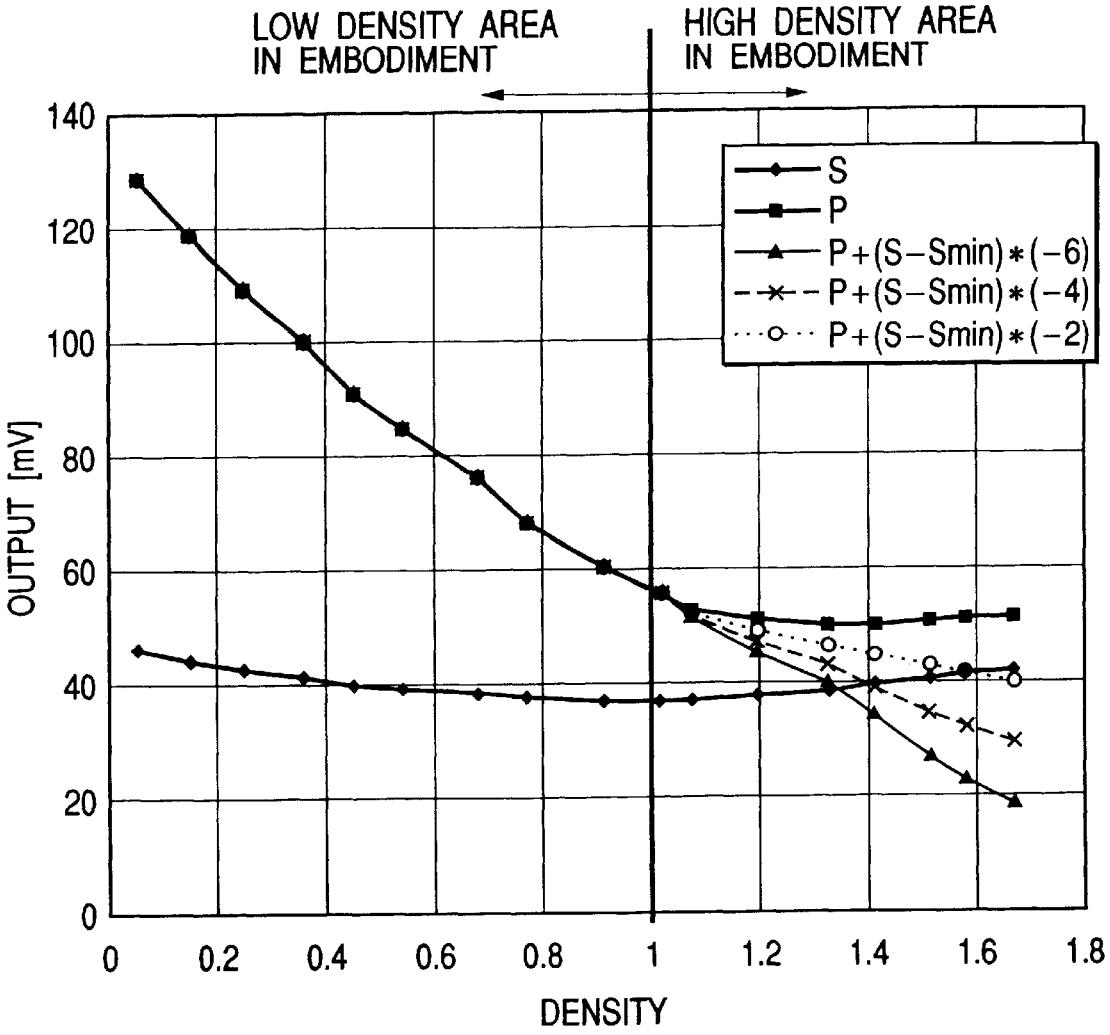
FIG. 10 is a graph showing a correcting method in Embodiment 5 of the present invention.

In the present embodiment, the correction coefficient, when based on a graph shown in FIG. 10, was set to −6 so as to assume a strong primary correlation.

That is, the output after corrections=regularly reflected light output (regularly reflected light output≧55 mV)

the output after correction=regularly reflected light output+(irregularly reflected light output−irregularly reflected light output min)×(−6)(regularly reflected light output<55 mV).

As in the present embodiment, the apparatus has a photosensor for detecting the density of the visualized toner image by the regularly reflected light and a photosensor for detecting the aforementioned density by the irregularly reflected light, and when the density of the color toner image is to be detected by the sensors, the toner image density correcting method at the quantity of regularly reflected light and the quantity of irregularly reflected light is changed in conformity with the quantity of regularly reflected light, and particularly the toner image density correcting method is changed between a case where the quantity of regularly reflected light is less than a predetermined quantity of light and a case where the quantity of regularly reflected light is equal to or greater than the predetermined quantity of light, whereby the toner image could be detected up to a higher density portion.

The demarcation between the low density area and the high density area is not limited to density 1.0, but is suitably changed depending on the output state of the sensors or the condition of the color or density of the toner image to be detected.

(Embodiment 6)

This embodiment is one in which the correction by irregularly reflected light in Embodiment 5 has been further promoted. The same portions of this embodiment as those of Embodiment 5 need not be described and only different portions will be described.

As shown in FIG. 3B, the quantity of irregularly reflected light is also changed for the density of the toner image. Accordingly, when it is desired to obtain the quantity of regularly reflected light strictly, it is necessary to remove the component corresponding to the quantity of irregularly reflected light.

Figure 11:
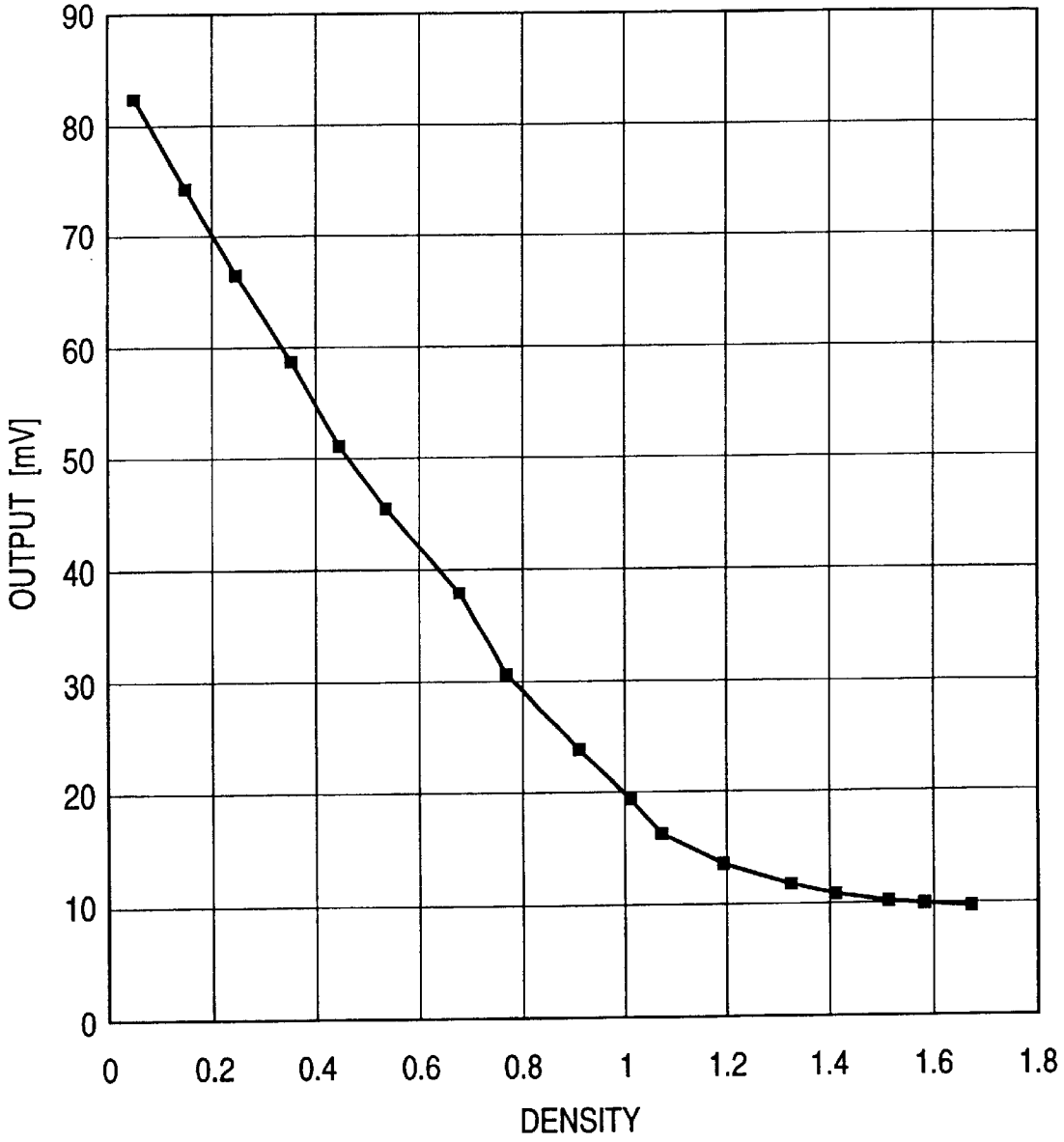
FIG. 11 is a graph showing the quantity of regularly reflected light—the quantity of irregularly reflected light to density in Embodiment 6 of the present invention.

The result obtained by subtracting the irregularly reflected light from the regularly reflected light in the integral type sensor shown in FIG. 8 is as shown in FIG. 11, and again becomes a gentle curve for density of 1.0 or greater, and sufficient sensor sensitivity cannot be obtained.

The correction subtracting the irregularly reflected light output from the regularly reflected light output is effected when the regularly reflected light output-irregularly reflected light output is equal to or greater than 19.5 mV corresponding to the density 1.0, and, in addition to the correction subtracting the irregularly reflected light output from the regularly reflected light output, the irregularly reflected light is further corrected by being multiplied by a suitable magnification when the regularly reflected light output-irregularly reflected light output is less than 19.5 mV.

Figure 12:
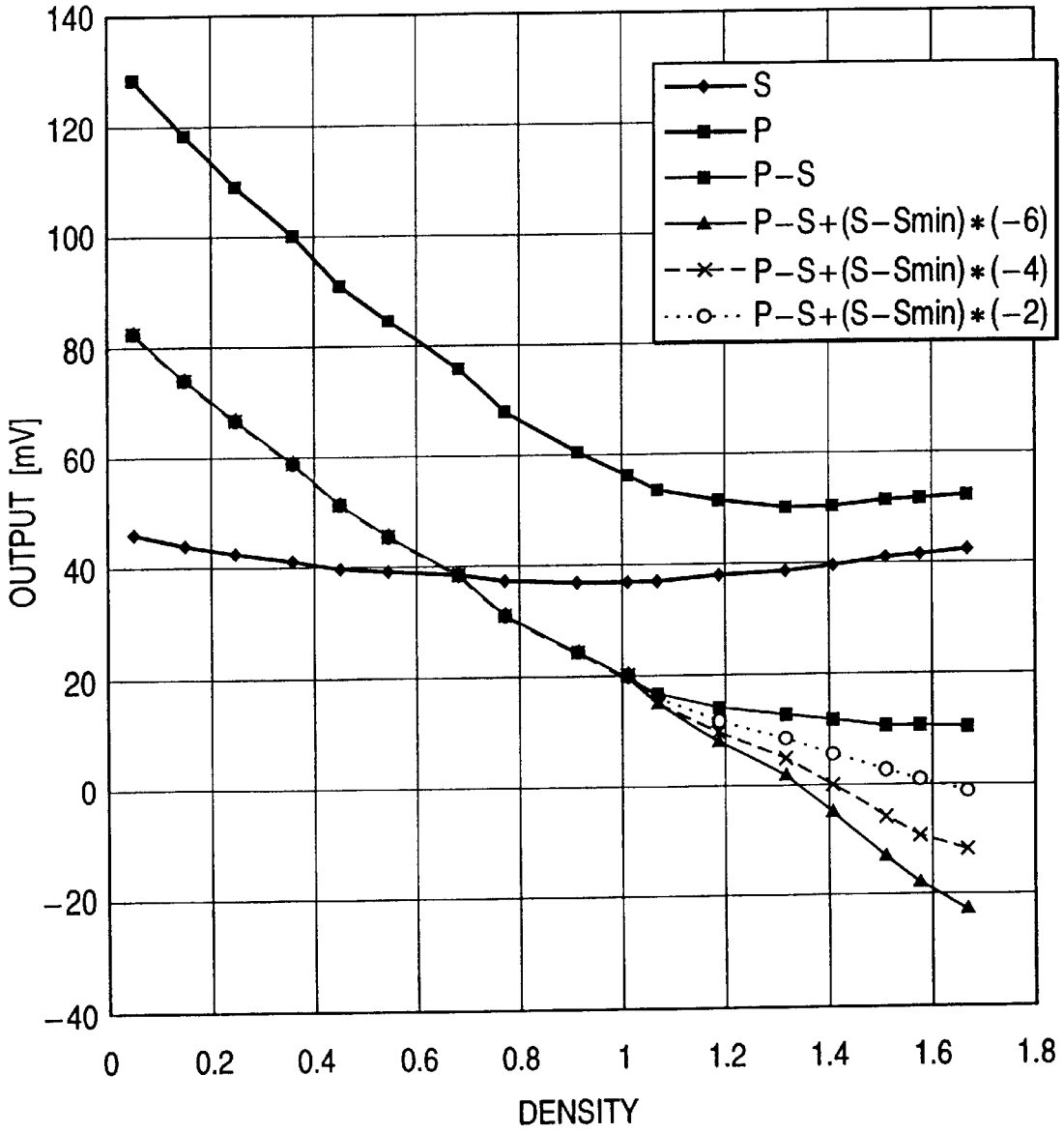
FIG. 12 is a graph showing a correcting method in Embodiment 6.

In the present embodiment, the correction coefficient was determined to −6 by a graph shown in FIG. 12.

That is,

Output after correction=regularly reflected light output−irregularly reflected light output (regularly reflected light output−irregularly reflected light output≧19.5 mV)

Output after correction=regularly reflected light output−irregularly reflected light output+min×(−6)(regularly reflected light output−irregularly reflected light output<19.5 mV)

Again in the present embodiment, the effect of the present invention was obtained and the toner image could obtained and the toner image could be detected up to the high density portion.

While in the described embodiments, the correcting methods as shown in the first to third embodiments have been described, it is also possible to suitably use correcting methods differing from these correcting methods.

Also, the effect of the present invention can be obtained even if the density of the toner image is detected not on the photosensitive drum as the image bearing member, but on a transferring member, but on a transferring member (including the surface of recording paper) or an intermediate transferring member as an image bearing member.

While the preferred embodiments of the present invention have been described above, the present invention is not restricted to these embodiments, but all modifications are possible within the technical idea of the invention.

What is claimed is:

1. An image forming apparatus comprising:

image forming means for forming a toner image;

first detecting means for detecting a quantity of regularly reflected light from the toner image;

second detecting means for detecting a quantity of irregularly reflected light from the toner image; and selecting means for selecting which of said detecting means is to be used for density detection, from among said first detecting means and said second detecting means, in conformity with a density of toner image to be formed.

2. An image forming apparatus according to claim 1, wherein said selecting means selects said second detecting means for a high density image, and said first detecting means for a low density image.

3. An image forming apparatus according to claim 2, wherein said selecting means selects said second detecting means during maximum-density control, and said first detecting means during halftone control.

4. An image forming apparatus according to claim 1, wherein said selecting means selects said second detecting means when the quantity of light detected by said first detecting means is equal to or greater than a predetermined value, and said first detecting means when the quantity of light detected by the second detecting means is less than the predetermined value.

5. An image forming apparatus comprising:

image forming means for forming a toner image;

first detecting means for detecting a quantity of regularly reflected light from the toner image;

second detecting means for detecting a quantity of irregularly reflected light from the toner image; and density calculating means for calculating a density of the toner image from the detection outputs of said first and second detecting means, and wherein said density calculating means changes a method of calculating the density of the toner image from the detection outputs of said first and second detecting means, on the basis of the detection output of the first detecting means.

6. An image forming apparatus according to claim 5, wherein said density calculating means calculates the density on the basis of only the detection output of said first detecting means when the detection output of said first detecting means is equal to or greater than a predetermined value, and calculates the density on the basis of the detection outputs of both of said first detecting means and the second detecting means when the detection output of said first detecting means is less than the predetermined value.

* * * * *

UNITED STATES PATENT AND TRADEMARK OFFICE

CERTIFICATE OF CORRECTION

PATENT NO. : 6,456,803 B2 
DATED : September 24, 2002
INVENTOR(S) : Kazuo Suzuki et al.

It is certified that error appears in the above-identified patent and that said Letters Patent is hereby corrected as shown below:

Column 1,
Line 17, “and” should read -- an --;
Line 29, “hearing” should read -- bearing --.

Column 9,
Line 4, “to” should read -- to be --;
Line 13, “could” should read -- could be --.

Signed and Sealed this

Twenty-fifth Day of February, 2003

JAMES E. ROGAN
*Director of the United States Patent and Trademark Office*